US008850725B2

(12) United States Patent
Hernandez

(10) Patent No.: US 8,850,725 B2
(45) Date of Patent: Oct. 7, 2014

(54) DEVICE AND SYSTEM FOR EXCAVATING AND BACKFILLING SOIL

(75) Inventor: Rigoberto Hernandez, North Palm Beach, FL (US)

(73) Assignee: RHL Holdings, LLC, North Palm Beach, FL (US)

( * ) Notice: Subject to any disclaimer, the term of this patent is extended or adjusted under 35 U.S.C. 154(b) by 387 days.

(21) Appl. No.: 13/215,570

(22) Filed: Aug. 23, 2011

(65) Prior Publication Data

US 2012/0047778 A1 Mar. 1, 2012

Related U.S. Application Data

(60) Provisional application No. 61/376,947, filed on Aug. 25, 2010.

(51) Int. Cl.
*E02F 1/00* (2006.01)
*E02F 5/12* (2006.01)

(52) U.S. Cl.
CPC ..... *E02F 5/12* (2013.01)
USPC ..... 37/466

(58) Field of Classification Search
USPC ..... 37/142.5, 466, 264, 265, 130–134, 284, 37/122, 285; 294/54.5, 49, 55, 51
See application file for complete search history.

(56) References Cited

U.S. PATENT DOCUMENTS

| | | | | |
|---|---|---|---|---|
| 813,050 | A | 2/1906 | Maine | |
| 1,112,016 | A | 9/1914 | MacLachlan | |
| 3,824,664 | A * | 7/1974 | Seeff | 428/604 |
| 4,245,411 | A * | 1/1981 | McMath | 37/265 |
| 4,562,678 | A * | 1/1986 | Carroll et al. | 52/302.3 |
| 4,607,872 | A * | 8/1986 | Herner | 294/54.5 |
| 5,056,245 | A | 10/1991 | Jenkins et al. | |
| 5,326,191 | A | 7/1994 | Wilson et al. | |
| 5,608,998 | A * | 3/1997 | Hume | 52/245 |
| 6,935,809 | B2 * | 8/2005 | Svensson | 405/107 |
| 7,255,512 | B2 | 8/2007 | Wallace | |
| 7,707,786 | B2 * | 5/2010 | Theophilus | 52/107 |

* cited by examiner

*Primary Examiner* — Robert Pezzuto
(74) *Attorney, Agent, or Firm* — McHale & Slavin, P.A.

(57) ABSTRACT

A trench edging member to be placed adjacent a trench or hole in the ground is designed to retain the soil removed from the trench, not destroy the landscape beneath the device, and enable an individual to readily replace the soil back into the trench or hole. A plurality of these devices can be placed adjacent each other so that a long trench can be dug filled with the required equipment or utilities, and the soil replaced back into the trench. The material employed for the device is formed into an undulating or wavy pattern when viewed in cross section. This enables a plurality of the devices to be nested or stacked atop one another for storage and/or transportation. The undulations also add rigidity to the device without adding weight to the device.

14 Claims, 8 Drawing Sheets

DEVICE AND SYSTEM FOR EXCAVATING AND BACKFILLING SOIL

CROSS REFERENCE TO RELATED APPLICATION

This application claims priority under 35 USC 119(e) to the U.S. Provisional Application No. 61/376,947, entitled "Device For Excavating And Backfilling Soil", filed Aug. 25, 2010, the contents of which are incorporated herein in their entirety.

FIELD OF THE INVENTION

The device and system for excavation of soil, retention and replacement of the soil disclosed herein; and relates generally to the placement and retention of soil removed from the earth when a trench or ditch is dug, and to the replacement of the soil back into the trench or ditch after the work has been completed.

BACKGROUND OF THE INVENTION

Trenches, ditches, and holes are formed in the earth for numerous reasons. One of the primary purposes is to bury utilities or other services underground. Trenches or ditches are also used to transport water and other fluids. Landscaping is another reason for digging holes and/or trenches, as well as hidden fences for animals, wiring for cable television or internet. Drainage is yet another reason to dig a trench. Trenches are normally excavated utilizing one of two methods, by machine or by hand.

There are various types of mechanized devices for digging trenches. Trenchers are by far the most common piece of equipment that is utilized to dig a trench. One type of trencher is the walk behind trencher. This device is similar to a lawnmower in that it includes a small engine and the operator walks behind the device as the trench is cut into the earth with an elongated chain or wheel. Wheeled or ride-on trenches are also available. These devices are similar to the walk behind devices with the exception that the operator rides upon these devices as the chain or wheel creates the trench as the device moves across the land. Once work is completed, workers must backfill the trench by hand recovering as much soil as possible while the rest is lost to the grass where the soil was piled. A backhoe is another type of device that is utilized to dig a trench. The soil or earth is removed with a large bucket and is generally placed adjacent to the trenching area. Upon completion of the work in the trench or hole, the backhoe retrieves as much of the soil removed from the trench as possible and roughly places some of it back into the trench. However, a large portion of the soil is lost to the area where it was deposited, scarring the ground and leaving an unsightly mess.

When a trench or ditch is dug by hand, the area in which the soil removed from the trench can be placed is normally limited by the length of the shovel. Therefore, the soil removed from the trench is usually placed adjacent the trench. If the trench is dug through an area with groomed grass, it is difficult to return all of the soil removed from the trench back into the trench because the soil falls to the ground and intermingles with the grass. The soil removed from the trench will not be able to be completely returned to the trench and will present an unsightly problem on the groomed grass once the trench is refilled. In some instances, rakes or the like are utilized in an attempt to return the soil back into the trench. However, this requires additional tools and additional labor.

Thus, in order to recover as much soil as possible as well as minimize the mess after work has been completed, a tarp or piece of material, such as plywood, is often placed on the grass adjacent the trench. The soil removed from the trench or hole is then placed atop the tarp or piece of material. A shortcoming to this procedure is that the plywood and/or tarp becomes too heavy for movement or dumping of the soil back into the trench thereby still requiring the soil to be shoveled by hand from the tarp or material back into the trench. The tarp can then be removed from the grass. If any soil remains on the plywood or tarp, it can be poured back into the trench only after a suitable amount of the weight has been removed therefrom. In addition, tarps and/or plywood are difficult to manipulate for arrangement along the length of the trench as well as dumping. Still yet, plywood is cumbersome to move from one location to another and requires a controlled environment to prevent degradation thereof. Tarps are easier to move from one location to another; however, they are fragile for use in this type of environment and thus are not practical for extended or daily use. In addition, tarps must be cleaned after use, requiring them to be hanged for drying adding significant labor and cost.

Thus, what is needed in the art is a device or system for use in excavation and backfilling of soil. The device or system should be formed of relatively few component parts that are inexpensive to manufacture by conventional techniques. The device or system should be capable of being shipped or transported in a nested arrangement to minimize space requirements. In addition, the system must be modular and facilitate the creation of a variety of trench edgers that vary in length/size but which share common, interchangeable components. The trench edgers must also be capable of overlapping engagement with respect to an adjacent trench edger to create elongated edgers. Finally, there are ergonomic needs that a trench edger device/system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from the storage volume of the trench edger, or otherwise negatively affect the utility of the trench edger.

SUMMARY OF THE INVENTION

A device or system to be placed adjacent a trench or hole in the ground is designed to retain the soil removed from the trench, not destroy the landscape beneath the device, and enable an individual to readily replace the soil back into the trench or hole. A plurality of these devices can be placed adjacent each other in interlocking engagement to accommodate a long trench so that the soil can be replaced back into the trench. The material employed for the device is preferably plastic formed into an undulating or wavy pattern, when viewed in cross section. This enables a plurality of the device to be nested or stacked atop one another for storage and/or transportation. The undulations also add rigidity to the device without adding weight to the device. The undulations also allow overlapping interlocking engagement between edger components to create a trench edger of infinite length. The assembly is completed without the need for tools or fastener components. Hand grips are provided along a top portion of each edger member to allow the soil placed thereon to be easily dumped back into the trench without undue effort.

Accordingly, it is an objective of the instant invention to provide a device that enables soil removed from a trench to be readily stored and easily replaced back into the trench.

It is a further objective of the instant invention to provide a device for retention of soil removed from a trench which can be easily manipulated by an individual.

It is yet another objective of the instant invention to provide a device for retention of soil removed from a trench whereby a plurality of edger devices can be placed in a side by side arrangement along the length of a trench.

It is still a further objective of the instant invention to provide a device for retention of soil removed from a trench formed with undulations or waves, in cross section, so that a plurality of devices can be stored or nested atop one another.

It is still a further objective of the instant invention to provide a device for retention of soil removed from a trench with undulations or waves, in cross section, so that a plurality of devices can be partially nested atop one another to enable them to be connected so as to form a substantially continuous piece.

It is still yet another objective of the instant invention to provide a device for the retention of soil removed from a trench whereby all of the soil is returned to the trench and none remains on the landscape adjacent the trench.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
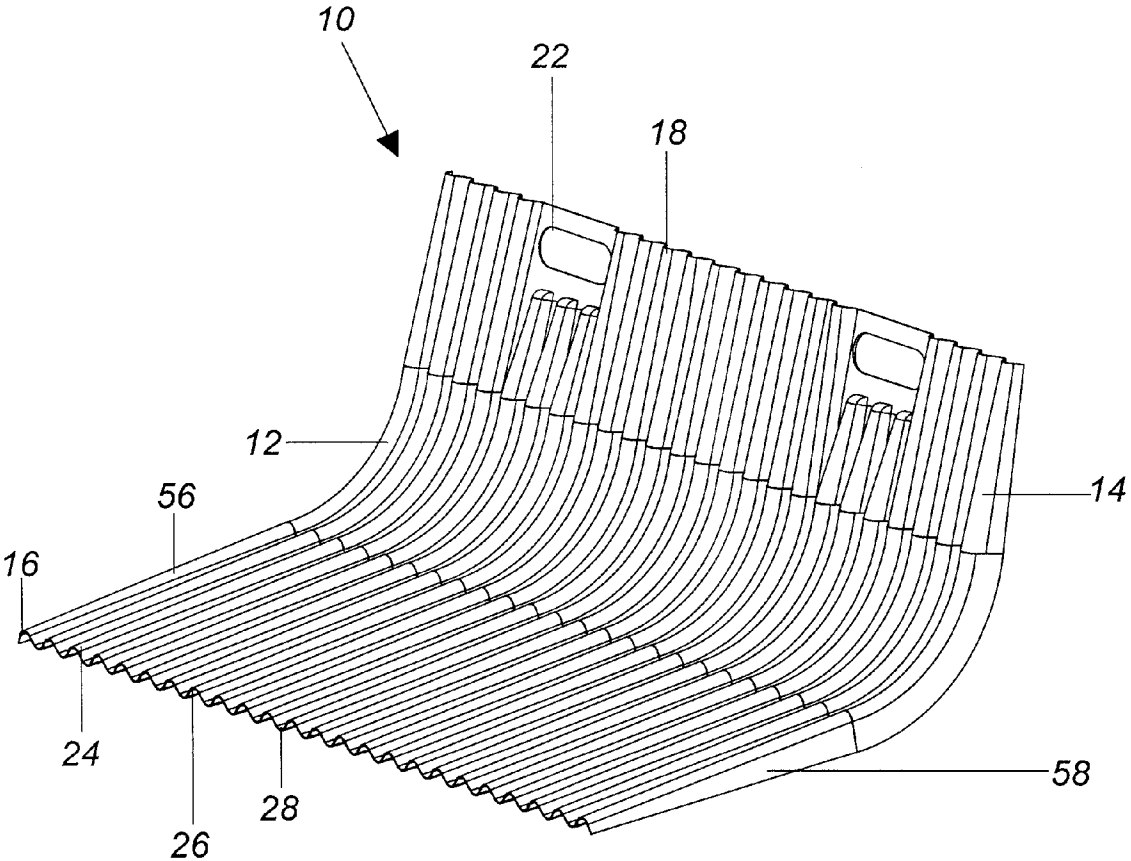
FIG. 1 is a perspective view of one embodiment of the present invention.
Figure 2:
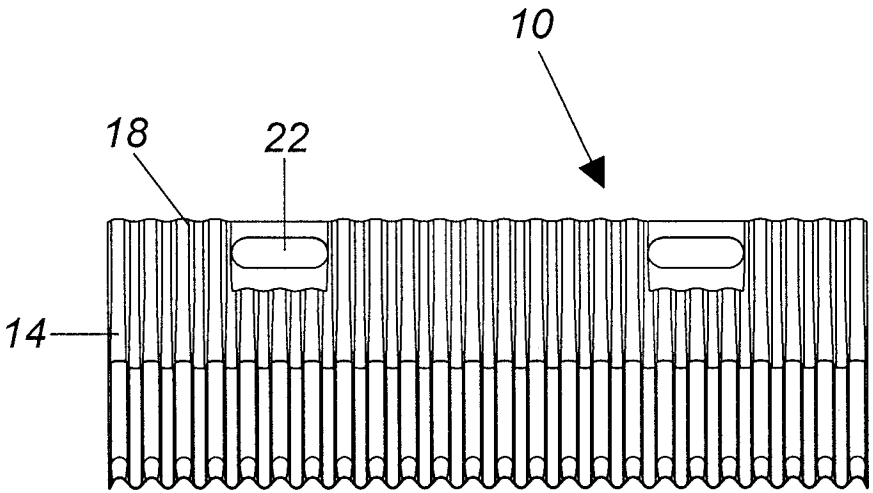
FIG. 2 is a rear view of the embodiment illustrated in FIG. 1.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

With reference to FIGS. 1-8, an illustrative embodiment of the soil excavation and backfilling device referred to herein as a trench edging member is indicated by the reference numeral 10. The trench edging member 10 can be made from various materials, such as polyethylene, high impact styrene, polycarbonates, or similar materials known to one skilled in the art. In a preferred embodiment, the trench edging member 10 is integrally molded into a single piece by a vacuum or injection molding process. Alternatively, the trench edging member 10 can be formed from multiple pieces which are later secured to each other to form the trench edging member 10. The method of manufacturing the trench edging member 10 will normally be determined by the finished size of the device. The larger sizes will be manufactured in sections and assembled prior to use. To increase longevity, the trench edging member 10 may also include or be constructed of materials which make the device resistant to the weather, leaching, and biodegradation, and retain their mechanical and chemical properties under low and/or high temperatures. Use of ultraviolet light inhibitors may be used to provide further protection from weather conditions.

Figure 3:
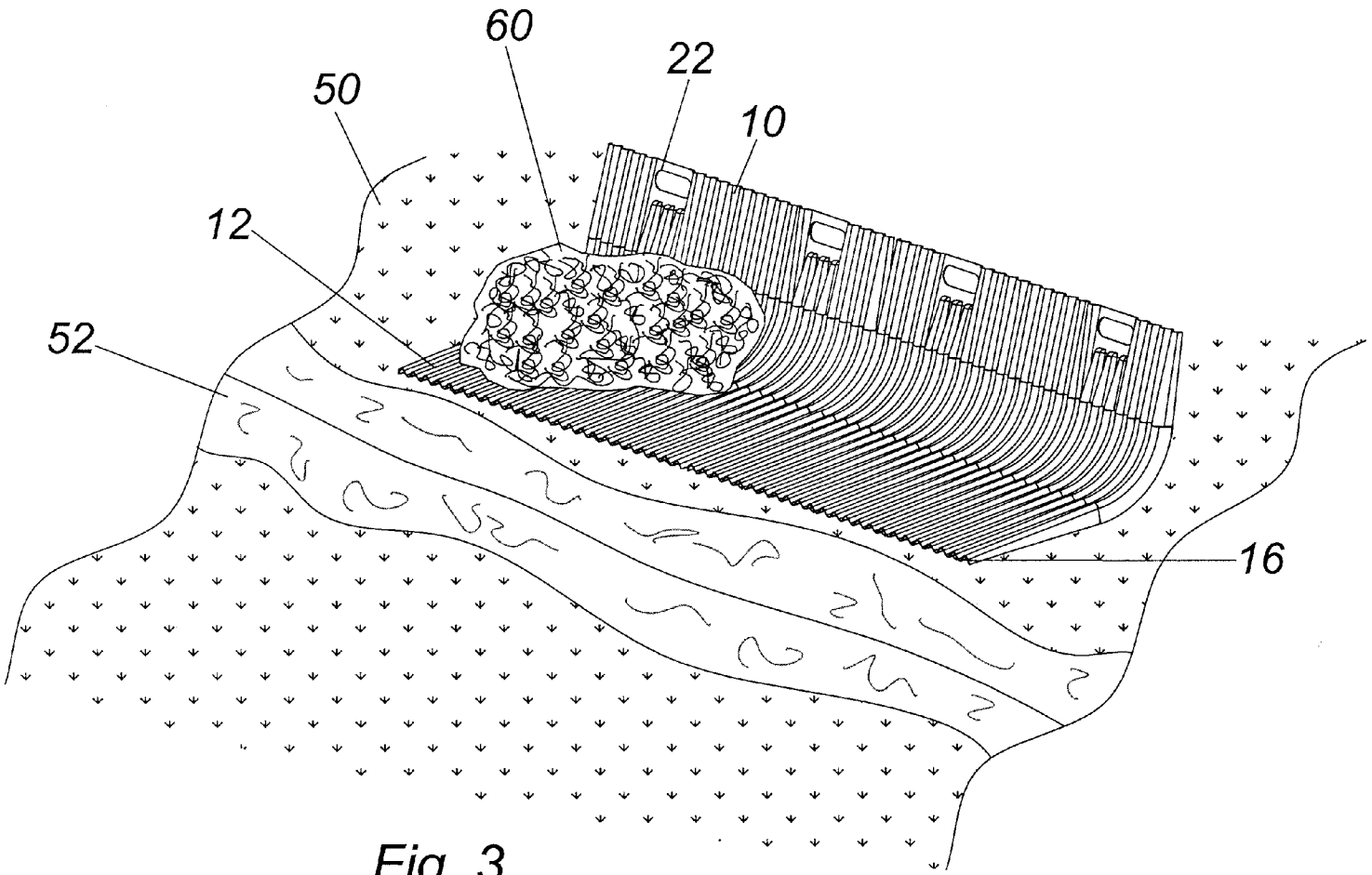
FIG. 3 is a perspective view illustrating overlapping interlocking engagement between multiple edging members.

The trench edging member 10 includes a substantially horizontal section 12 and an inclined vertical section 14. While in a preferred embodiment sections 12 and 14 are integrally formed, they could also be formed separately and later joined together. Section 12 is constructed so that it can be placed on the ground or earth 50 adjacent a trench 52 or hole to be excavated, as shown in FIG. 3. Section 14 is positioned to be angled to vertical to form a back stop for soil as it is thrown onto the trench edging member. Section 12 includes a longitudinal edge 16, rear edge 18, and side edges 56, 58. In the preferred embodiment, the longitudinal edge 16 is formed straight so that it may be employed as a guide line for digging a trench. To use the present invention in this manner, a line or string can be set along the ground indicating one side of a trench to be dug. A plurality of trench edging members 10 can be placed adjacent each other, end to end or in overlapping engagement, along the line. The line or string can then be removed and the trench dug along the longitudinal edge. This avoids the problem of breaking the line or string with a shovel when the trench is being dug. The trench edging members 10 are made from a material which can readily absorb hits or blows from a shovel without moving from the position in which they were placed.

Figure 9:
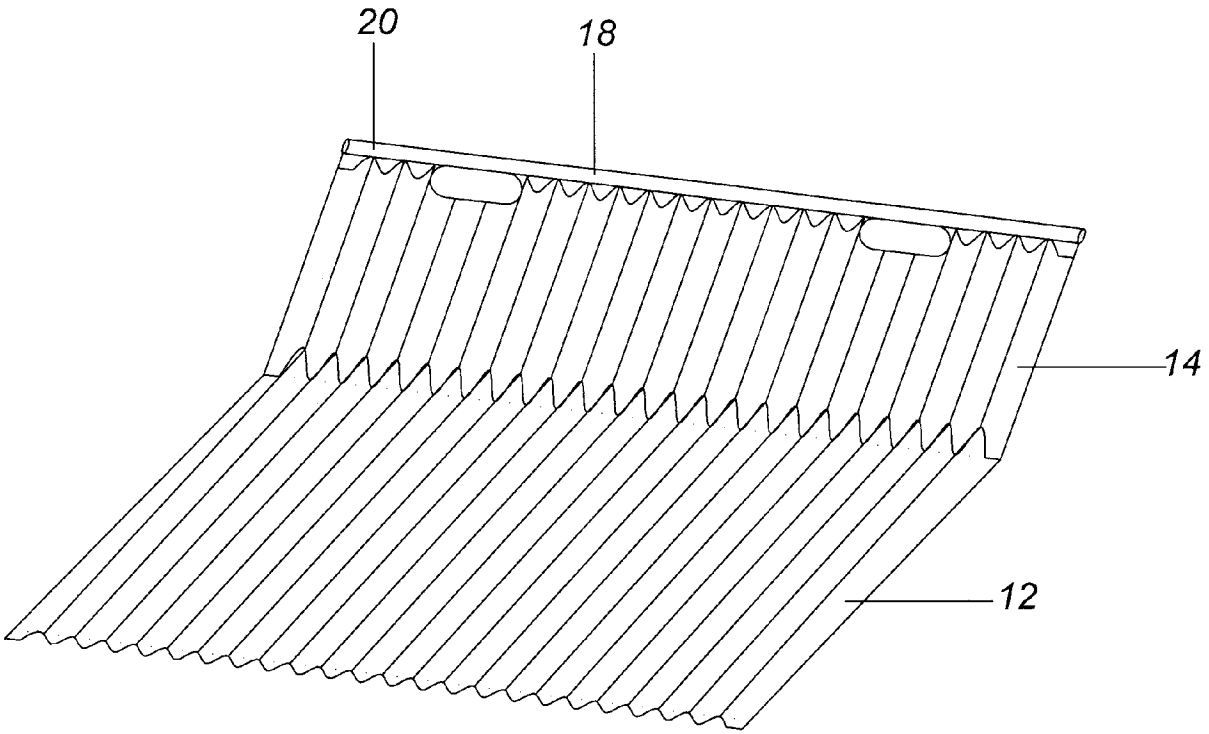
FIG. 9 is a perspective view of an alternative embodiment of the present invention.

The excavation and backfilling device 10 includes an inclined substantially vertical section 14. Inclined vertical section 14 includes a rear longitudinal edge 18 which extends along a top portion of section 14. The rear longitudinal edge 18 may include a rounded top 20, as shown in FIG. 9, which extends along the length of edge 18. The rounded top 20 is designed to assist an individual in carrying and manipulating the trench edging member 10 into position for use. Rounded top 20 is also used to assist an individual in raising the rear portion of the trench edging member 10 for dumping the dirt contained thereon back into the trench or hole. Edge 18 can also be provided with a plurality of hand apertures 22. These apertures function as hand grips to assist an individual in raising trench edging member 10 for dumping the dirt contained thereon back into the trench or hole. The number of apertures 22 varies dependent on the length of the trench edging member 10. In a most preferred embodiment, two holes are provided to allow an operator to utilize both hands to manipulate the device.

Figure 4:
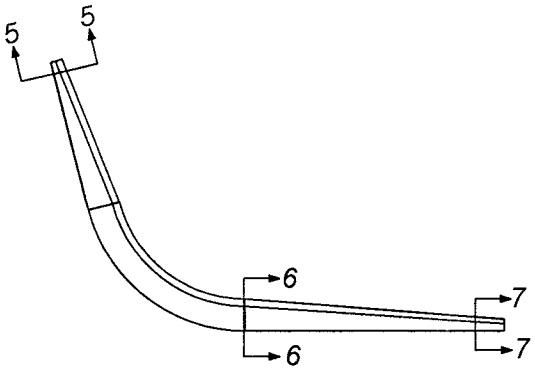
FIG. 4 is a left end view of the embodiment illustrated in FIG. 1.
Figure 8:
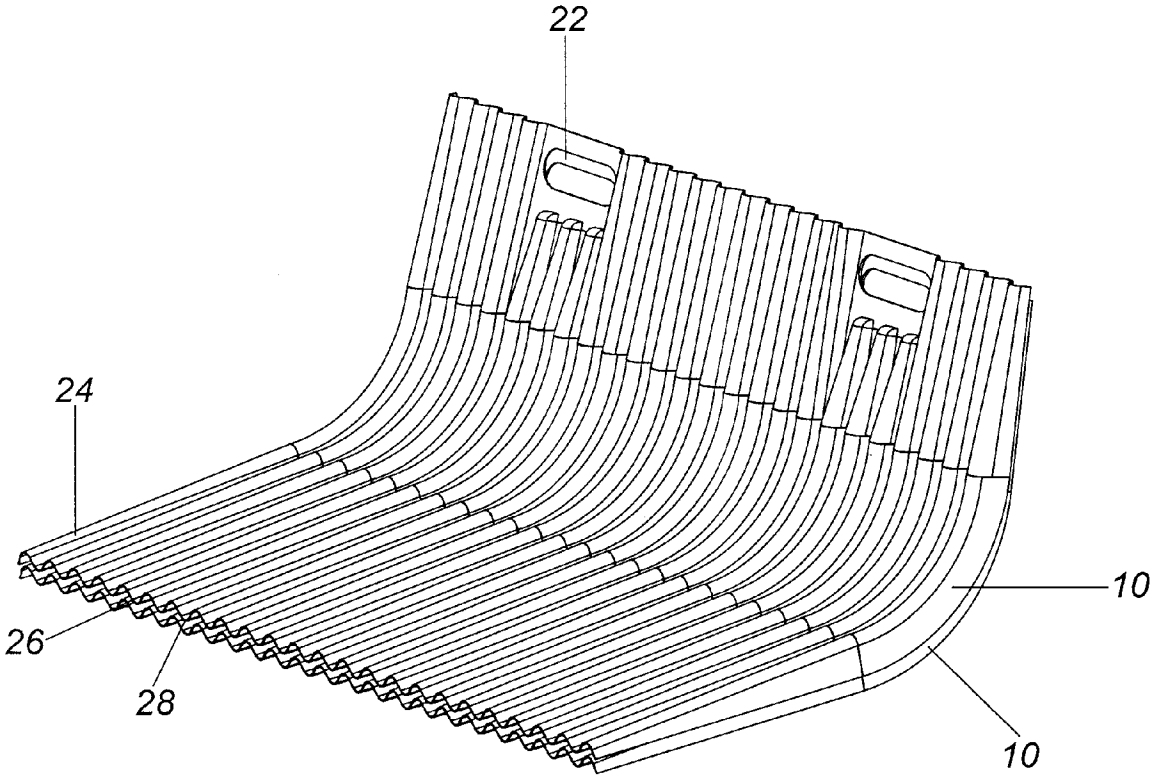
FIG. 8 is a perspective view illustrating a plurality of edger members in a nested arrangement.

Referring to FIG. 8, a plurality of trench edging members are illustrated in a nested configuration. The trench edging member 10 is formed with a plurality of projections or undulations 24. The projections 24 include peaks 26 and are separated by valleys 28. The peaks and valleys of the preferred embodiment are evenly spaced and designed so that a plurality of the trench edging members 10 can be nested or stacked atop one another, as illustrated in FIG. 4. The peaks 26 of one of the trench edging members 10 will readily fit under the peak 26 of another trench edging member 10. This construction enables one device to be nested or stacked atop another device while the only vertical distance between the devices is the thickness of the material used to form the devices. Without this type of construction the distance between each of the devices in a stack would be at least the height of each of the projections. In addition to occupying less space, this type of construction and stacking permits a plurality of devices to be stacked and interlocked together. This interlocking prevents the devices from separation from one another during shipping and storage. This feature is very useful when a large number of trench edging members 10 are shipped or transported to a construction site. In addition, this nesting feature enables adjacent trench edging members 10 to be partially overlapped or nested and secured to one another. A plurality of devices can be connected to each other in this manner so as to create a substantially continuous piece as illustrated in FIG. 3. This feature aids in the alignment of a plurality of the devices along a trench.

Figure 5:
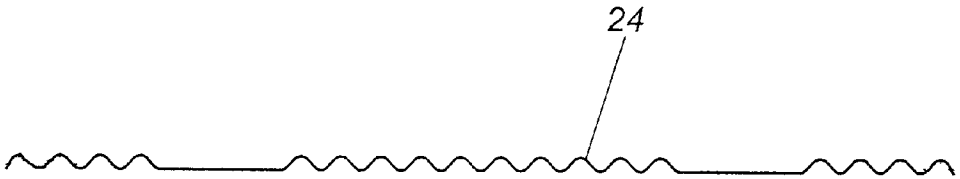
FIG. 5 is a cross sectional view taken along line 5-5 of FIG. 4.
Figure 6:
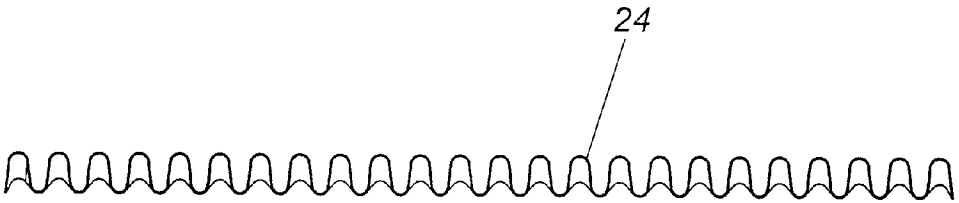
FIG. 6 is a cross sectional view taken along line 6-6 of FIG. 4.
Figure 7:
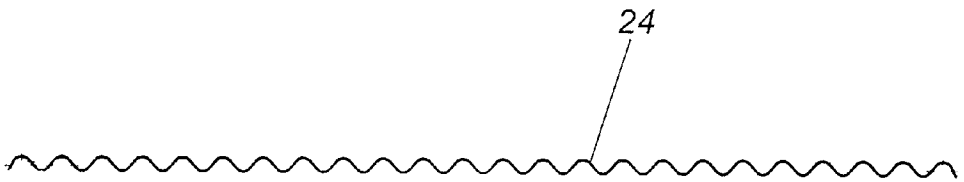
FIG. 7 is a cross sectional view taken along line 7-7 of FIG. 4.

Referring to FIGS. 4-7, the height of projections 24 is increased as it approaches the junction of sections 12 and 14, as seen in FIGS. 5, 6, and 7. The height of projection 24 at the outer edges of sections 12 and 14 is indicated along lines 5-5 and 7-7 and the height of projections 24 at the junction of sections 12 and 14 is indicated along lines 6-6. It can be clearly seen that the height of the projections at line 6-6, FIG. 6 is larger than line 5-5, FIG. 5 and line 7-7 FIG. 7. This increase in the height of the projections 24 adds to the rigidity of the junction of sections 12 and 14. This increase in rigidity enables an individual to lift the trench edging member 10 by handles 22 having rounded top 20 of without the device breaking or buckling.

Referring to FIG. 3, use of the trench edging member 10 is illustrated. To use the trench edging member 10, an individual will place the trench edging member 10 adjacent a trench 52 or hole to be dug in the ground or earth 50. The dirt or soil 60 removed from the ground is placed on section 12 of the trench edging members 10. This prevents the soil 60 removed from the trench from contacting the ground 50. When the trench edging member 10 is used on a lawn or other area containing groomed grass or groundcover, the soil 60 removed from the trench is prevented from contacting the underlying grasses or groundcover. After the trench 52 or hole has been dug and the work performed within the trench finished, the soil 60 removed from the trench 52 can readily and quickly be replaced into the trench 52. This is accomplished by lifting the trench edging members 10 by the handles 22, thus tilting section 12 towards the trench. The soil 60 contained on section 12 will now slide back into the trench 52. This avoids the laborious task of shoveling the soil 60 back into the trench 52. In addition, all of the soil 60 removed from the trench 52 will be returned to the trench since it is contained on the trench edging members 10. None of the soil will fall onto the underlying ground or grass.

Referring to FIG. 9, an alternative embodiment of the trench edging member 10 is illustrated. In this embodiment, the rear edge 18 is provided with a rolled or rounded top 20. The rolled or rounded top edge 20 provides a comfort grip to a user of the trench edging member 10 and further allow the use of the user's legs and/or knees to help with dumping of the soil back into the trench.

Figure 10:
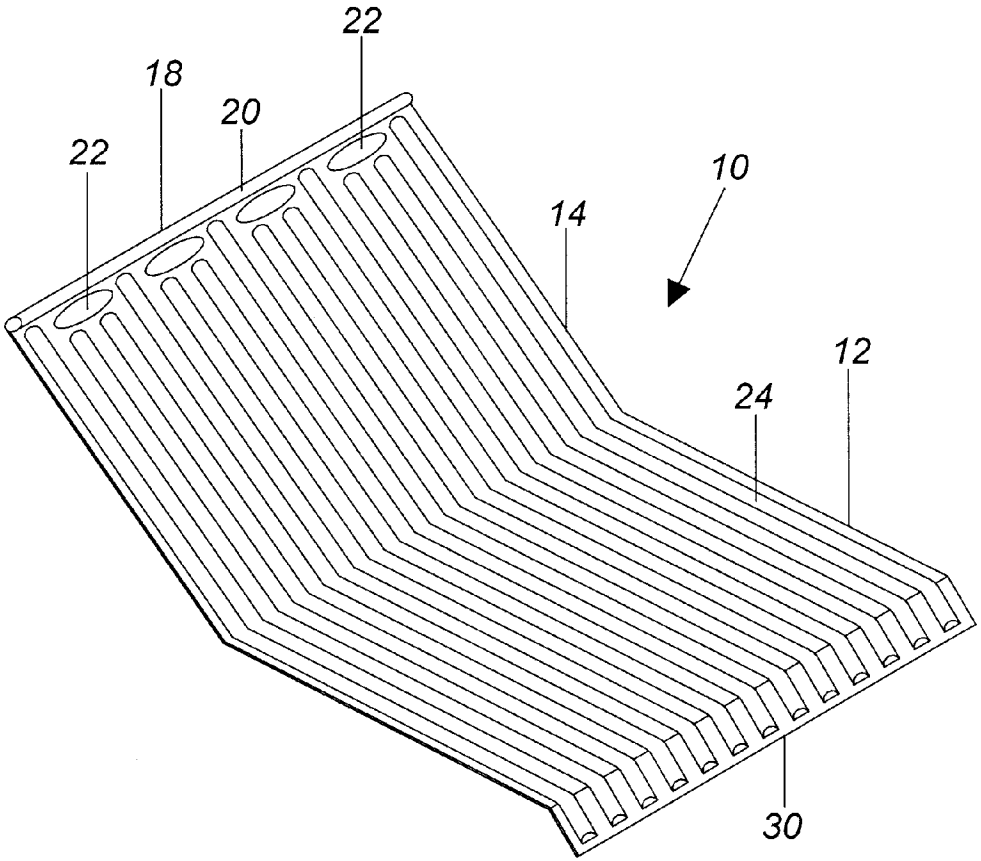
FIG. 10 is a perspective view of an alternative embodiment of the present invention.

Referring to FIG. 10, an alternative embodiment of the trench edging member 10 is illustrated. In the embodiment of the device illustrated in FIG. 1, the longitudinal front edge 16 is replaced by a depending front edge portion 30. This depending front edge portion 30 extends downwardly and away from section 12. This embodiment can be employed when a further extension of section 12 is required.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A trench edging member comprising:

a substantially rectangular shaped horizontal section constructed to be placed on a ground surface adjacent a trench to be excavated, said horizontal section including a longitudinal front edge and a pair of side edges, an inclined vertical section joined to said substantially horizontal section forming a back stop for soil as it is thrown onto the trench edging member, said vertical section being substantially rectangular in shape and substantially the same width as said horizontal section, said vertical section including a rear longitudinal edge;

said horizontal and said vertical sections of said trench edging member being formed with a plurality of undulations having peaks separated by valleys, said peaks and valleys spaced for nested engagement with like constructed trench edging members in a stacked arrangement, said undulations include a height, said height of said undulations increasing as they approach the junction between said horizontal section and said vertical section, whereby the buckling strength of said trench edging member is increased.

2. The trench edging member of claim 1 wherein said trench edging member is integrally molded as a single piece.

3. The trench edging member of claim 1 wherein said peaks and said valleys of said undulations are shaped and spaced so that at least one trench edging member can be partially overlapped upon an adjacently positioned trench edging member in a nested relationship to construct an elongated trench edging member.

4. The trench edging member of claim 1 wherein said longitudinal front edge is formed straight so that it may be employed as a guide line for digging a trench.

5. The trench edging member of claim 1 wherein said longitudinal rear edge is provided with a plurality of hand apertures to assist an individual in carrying and manipulating said trench edging member.

6. The trench edging member of claim 5 wherein said rear longitudinal edge includes a rounded top, said rounded top constructed and arranged to assist an individual in carrying and manipulating said trench edging member.

7. The trench edging member of claim 1 wherein said longitudinal front edge includes a depending front edge, said depending front edge extending downwardly and away from said horizontal section for overlapping an edge of a trench.

8. The trench edging member of claim 1 wherein said trench edging member is formed from plastic.

9. The trench edging member of claim 8 wherein said trench edging member is formed by the process of vacuum forming.

10. The trench edging member of claim 8 wherein said trench edging member is formed by the process of injection molding.

11. A trench edging member comprising:

a substantially horizontal section constructed to be placed on a ground surface adjacent a trench to be excavated, said horizontal section including a longitudinal front edge and a pair of side edges, an inclined vertical section integrally formed to said substantially horizontal section forming a back stop for soil as it is thrown onto the trench edging member, said vertical section including a rear longitudinal edge, said horizontal and said vertical sections of said trench edging member being formed with a plurality of undulations having peaks separated by valleys, said undulations providing strength against buckling of said trench edging member when loaded with soil, said peaks and valleys spaced for nested engagement with like constructed trench edging members in a stacked arrangement, said undulations including a height, said height of said undulations increasing as they approach the junction between said horizontal section and said vertical section, whereby the buckling strength of said trench edging member is increased.

12. The trench edging member of claim 11 wherein said longitudinal rear edge is provided with a plurality of hand apertures to assist an individual in carrying and manipulating said trench edging member.

13. The trench edging member of claim 11 wherein said rear longitudinal edge includes a rounded top, said rounded top constructed and arranged to assist an individual in carrying and manipulating said trench edging member.

14. The trench edging member of claim 11 wherein said peaks and said valleys of said undulations are shaped and spaced so that at least one trench edging member can be partially overlapped upon an adjacently positioned trench edging member in a nested relationship to construct an elongated trench edging member.

* * * * *